US005662240A

United States Patent [19]

Norris

[11] Patent Number: 5,662,240

[45] Date of Patent: Sep. 2, 1997

[54] DISPOSABLE PLATE WITH FLEXIBLE HANDLES

[76] Inventor: Jeffrey W. Norris, 18-17-502B Chiyoda 4-chome, Naka-Ku, Nagoya, Japan, 460

[21] Appl. No.: 600,494

[22] Filed: Feb. 13, 1996

[51] Int. Cl.[6] ..... A61D 73/00

[52] U.S. Cl. ..... 220/574; 220/23.83; 220/575; 220/561

[58] Field of Search ..... 220/754, 23.83, 220/575, 23.8, 561; 206/502, 557, 1.7

[56] References Cited

U.S. PATENT DOCUMENTS

| | | | |
|---|---|---|---|
| 3,915,371 | 10/1975 | Crabtree | 229/15 |
| 4,732,274 | 3/1988 | Bouton | 220/23.8 |
| 4,867,331 | 9/1989 | Task | 220/23.83 |
| 5,076,438 | 12/1991 | Aaronson | 206/557 |
| 5,110,170 | 5/1992 | Boatwright | 220/23.83 |
| 5,119,967 | 6/1992 | Ercolani | 220/23.8 |
| 5,259,528 | 11/1993 | Pace et al. | 220/23.8 |

*Primary Examiner*—Joseph M. Moy

[57] ABSTRACT

A disposable plate with handles attached to the underside. The handles comprise two loop-shaped members protruding downward from the plate into which the user places thumb and forefinger, thereby obtaining greater control of the plate than is possible with many disposable plates. Also, the handles are spaced sufficiently apart so that the user can carry plate and cup simultaneously in the same hand.

2 Claims, 1 Drawing Sheet

DISPOSABLE PLATE WITH FLEXIBLE HANDLES

BACKGROUND—FIELD OF INVENTION

This invention relates to disposable plates, specifically to an improved method for carrying such plates.

BACKGROUND OF THE INVENTION

Disposable plates are often used in place of regular dinner plates. At many gatherings, people stand and mingle with others while carrying around plates and cups.

At such gatherings, guests carry plate in one hand and cup in the other hand. This leaves no hand for picking up food or handling eating utensils. Guests are forced to constantly search for somewhere to put their drinks while eating. Free movement is hampered and the whole event is generally not as pleasant as it could be.

To combat this inconvenience, inventors built trays with built-in cup recesses. U.S. Pat. No. 3,915,371 to Crabtree (1975) discloses a nestable tray with cup supporting recess; however, this tray represented a radical change in accepted plate design and was bulkier than standard plates. Also, though it is somewhat related to the present invention, this tray was designed primarily for restaurant carry-out use.

It would be desirable, therefore, to develop a disposable plate with handles attached to the underside that provide a sturdy and reliable means for carrying plate and cup in one hand and that this plate be inexpensive to produce.

SUMMARY OF THE INVENTION

The present invention relates to disposable plates, particularly to the addition of handles to the underside of the plate. These flexible handles are in the form of two small rings, attached separately and protruding downward from the bottom of the plate, into which the user places forefinger and thumb. This grip roughly resembles that of a person wielding a pistol.

The rings can either be pulled slightly together or pushed slightly apart. If the user wishes to carry a cup and plate in the same hand, he/she simply places the cup between the two rings and carries the cup as usual.

The present invention is particularly advantageous in several respects. First, the user can securely hold a plate and cup in one hand while eating with the other hand. Banquets or other similar "standing parties" can proceed more smoothly. Also, since the plate is held from the center—instead of the edge—there is less danger of spilling the contents. The disposable plate with handles is the same shape and almost the same size as regular plates so it can be readily stacked. Finally, the present invention is simply designed and inexpensive to produce. Disposable plates currently on the market can easily be converted to the present invention.

OBJECTS AND ADVANTAGES (a) to provide a disposable plate with handles attached to the underside, providing a means for holding plate and cup simultaneously in one hand.

(b) to provide a disposable plate that can be held more securely than is possible with many disposable plates currently in use.

(c) to provide a disposable plate with handles attached to the underside that is simple to use and inexpensive to manufacture.

(d) to provide a disposable plate with handles attached to the underside which can be easily stacked.

These and other objects and advantages will be made more apparent from the ensuing drawings and descriptions.

DRAWING FIGURES

Reference Numerals in Drawing

Figure 1:
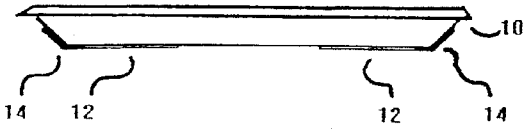
FIG. 1 shows a side view of the disposable plate before use.

10 plate
12 flexible handles
14 stems

DESCRIPTION OF THE PREFERRED EMBODIMENT

As shown in FIGS. 1, 2, 3, 4, and 5, the present invention provides a plate 10 with handles 12 attached at their respective stems 14.

Disposable plates of any size currently in use can easily be used in the present invention. These materials include paper, plastic, cardboard, etc. In the preferred embodiment the material is paper.

Figure 2:
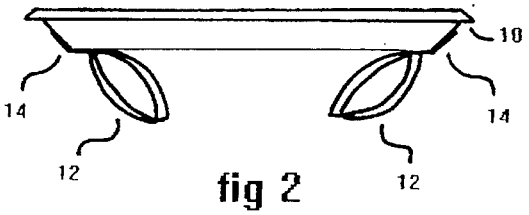
FIG. 2 shows a side view of the disposable plate ready for use.

The handles 12 can likewise be made of paper, plastic, cardboard, etc., with the preferred material being paper. The handles in the preferred embodiment are two paper loops, each approximately 9 cm in circumference and 1 cm in width. From each handle there extends a roughly 1 cm stem 14. These are attached by adhesive means near the outer edge on opposite sides of the underside of the plate 10. These two loops are thus held fast on the outer edge of the bottom of the plate but move freely up and down on the inside part of the plate, as can be seen in FIG. 2.

When flat against the plate, there is an approximately 3 cm gap between the handles. When the handles are fully raised, this gap is about 12 cm. Thus almost any cup can be held beneath the plate, as in FIG. 4. When the loops of the handles are open, the diameter is sufficiently large enough to allow passage of fingers of any size.

Operation

Figure 3:
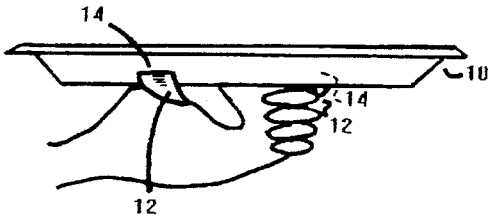
FIG. 3 shows a side view of the disposable plate in use without cup.
Figure 4:
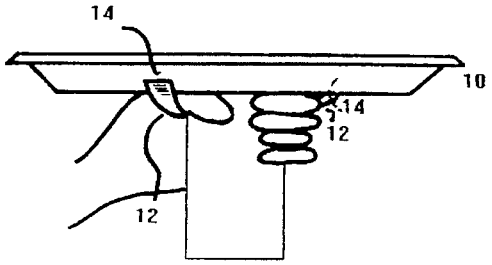
FIG. 4 shows a side view of the disposable plate in use with cup.
Figure 5:
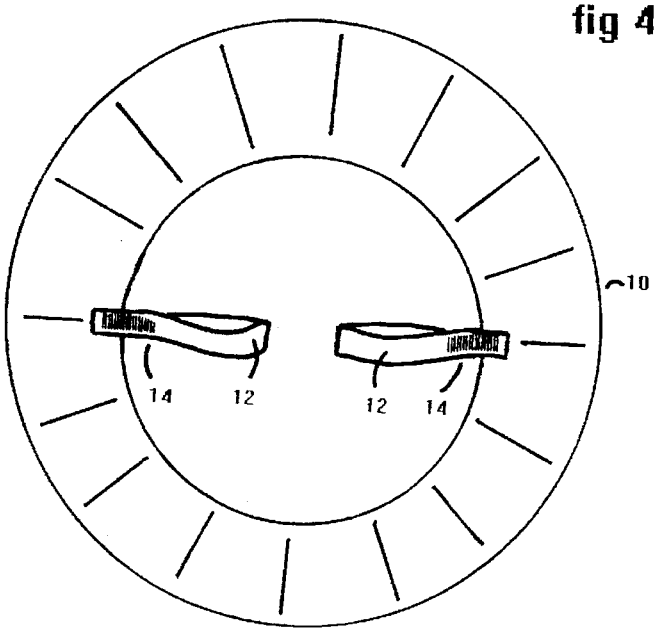
FIG. 5 shows a bottom view of the disposable plate.

The user places his forefinger and thumb through the handles 12 and squeezes slightly to hold the plate 10 as in FIG. 3. The plate 10 is supported from the sides and from the user's hand near the center of the plate. When the user holds a cup in the same hand, the mouth of the cup rests at or near the center of gravity of the plate. The user is then able to apply downward pressure on the plate by pulling the handles down and gripping the sides of the cup.

Ramifications and Scope

The reader can see that the present invention fulfills a pressing need by providing a disposable plate that:

allows the user to carry cup and plate in one hand provides a secure means for holding the plate accomplishes the above without dramatic changes in accepted plate design or high manufacturing costs Although the description above contained many specificities, these should not be construed as limiting the scope of the invention but as merely providing illustrations of one of the presently preferred embodiments of the invention. For example, the handle might have a wider stem for extra support; more handles could be added to a single plate; the handle could be part of the original plate and not added, etc.

Thus the scope of the invention should be determined by the appended claims and their legal equivalents, rather than by the examples given.

I claim:

1. On a disposable plate comprising a type intended for dispensing food the improvement wherein said plate having an underside with a plurality of loop-shaped members attached whereby a human can conveniently support said plate with a plurality of digits of one hand placed through their respective opposing loops while simultaneously sandwiching a beverage container between said digits.

2. The flexible loops of claim 1 wherein said loops are substantially an integral and homogeneous element of said plate manufacture.

* * * * *